United States Patent [19]

Cahill et al.

[11] Patent Number: 4,856,536

[45] Date of Patent: Aug. 15, 1989

[54] CIGARETTE MANUFACTURE

[75] Inventors: Michael J. Cahill, Coventry, England; Michael D. Simcoe, Canberra, Australia; John D. Stanton, Coventry; Brian H. Warner, Bucks, both of England

[73] Assignee: Molins PLC, Wycombe, England

[21] Appl. No.: 49,938

[22] Filed: May 15, 1987

[30] Foreign Application Priority Data

May 15, 1986 [GB] United Kingdom ..... 8611874
Nov. 8, 1986 [GB] United Kingdom ..... 8626728

[51] Int. Cl.[4] ..... A24B 15/28; A24C 15/18; A24D 1/00; A24D 1/18

[52] U.S. Cl. ..... 131/28; 131/29; 131/31; 131/37; 131/62; 131/79; 131/88; 131/90

[58] Field of Search ..... 131/280, 29, 31, 37, 131/62, 79, 88, 90, 28

[56] References Cited

U.S. PATENT DOCUMENTS 3,985,144 10/1976 Payne ..... 131/29
4,619,276 10/1986 Albertson et al. ..... 131/31

*Primary Examiner*—V. Millin
*Attorney, Agent, or Firm*—Antonelli, Terry & Wands

[57] ABSTRACT

Apparatus for applying measured quantities of foamed adhesive to the ends of cigarettes comprises a drum 10 arranged to having apertures 14A aligned with the respective cigarettes 12 and arranged to recieve foam from a source 18 adjacent to the plate, characterized by means 24,26 for pneumatically transferring foam progressively from each aperture to the end of the corresponding cigarette, i.e. during a significant arc of rotation of the drum.

14 Claims, 3 Drawing Sheets

14
14A
26
26A
24
16
12
10
32
20
18
34

CIGARETTE MANUFACTURE

This application is concerned with improvements in the invention described in our U.S. application Ser. No. 909,234, filed Aug. 20, 1985. That specification describes in particular the application of foamed adhesive to the tobacco ends of cigarettes to reduce or eliminate the loss of tobacco from the ends.

According to one aspect of the present invention, apparatus for applying measured quantities of foamed adhesive to the ends of cigarettes comprises a drum arranged to carry cigarettes sideways, and a plate (preferably in the form of a separate disc co-axial with the drum) having apertures aligned with the respective cigarettes and arranged to receive foam from a source adjacent to the plate, characterised by means for pneumatically transferring foam progressively from each aperture to the end of the corresponding cigarette.

Suction may be applied to the other end of the cigarette (normally formed by a filter) and/or around the cigarette to assist in drawing the foam into the tobacco end. In addition, or as an alternative, pressure air directed onto a number of apertures at the same time may be used to progressively transfer the foam from the apertures onto the cigarettes; i.e. as opposed to the instantaneous operation described in our above-mentioned patent.

Each cigarette may be brought into abutment with the disc. For example, the cigarette may be pressed lightly onto the disc by a flexible sealing member at the filter end by which suction is subsequently applied to assist in drawing the foam into the tobacco ends.

The composition of the foam may be as described in our above referenced U.S. application. A flavoring ingredient may be included in the foam to enhance the taste of the first one or two puffs taken by the smoker.

Examples of foam-applying apparatus according to this invention are shown in the accompanying drawings. In these drawings.

Figure 1:
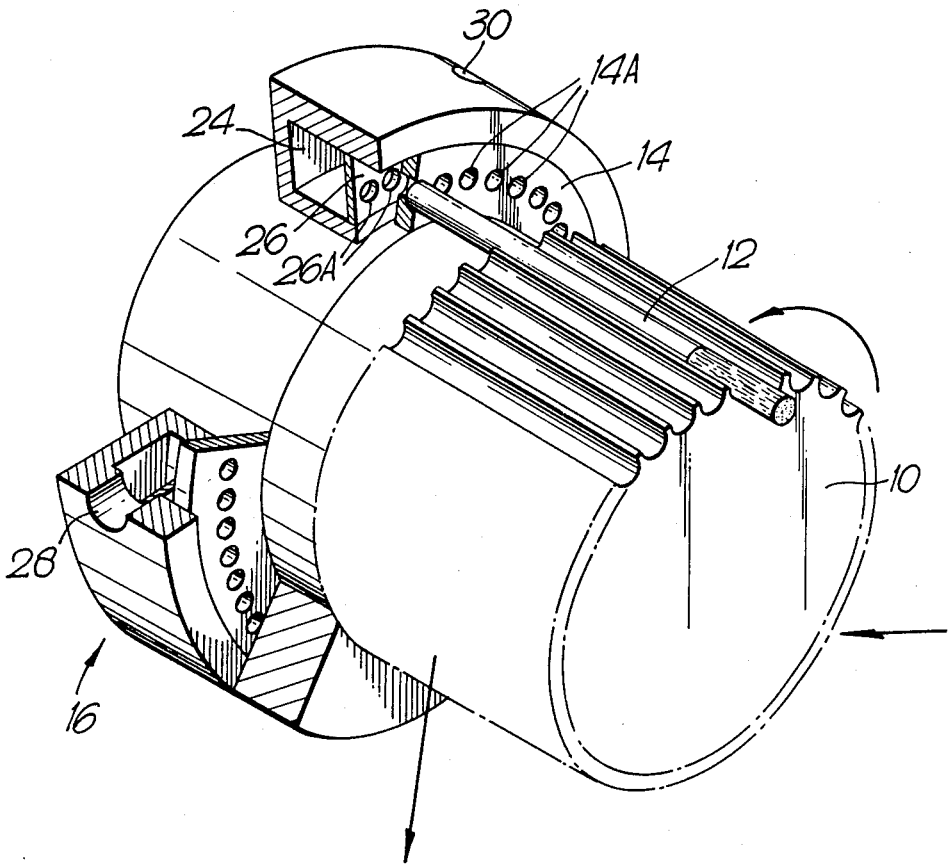
FIG. 1 is a perspective view, partly broken away, of part of the apparatus.

FIG. 1 shows a fluted drum 10 which is arranged to carry cigarettes 12 while foam is transferred onto the adjacent cigarette ends from apertures 14A in a plate member in the foam of a separate disc 14 by means of a manifold arrangement 16. The cigarettes are transferred to and from the drum 10 by additional fluted drums which are not shown.

Figures 3A, 3B, 3C, 3D:
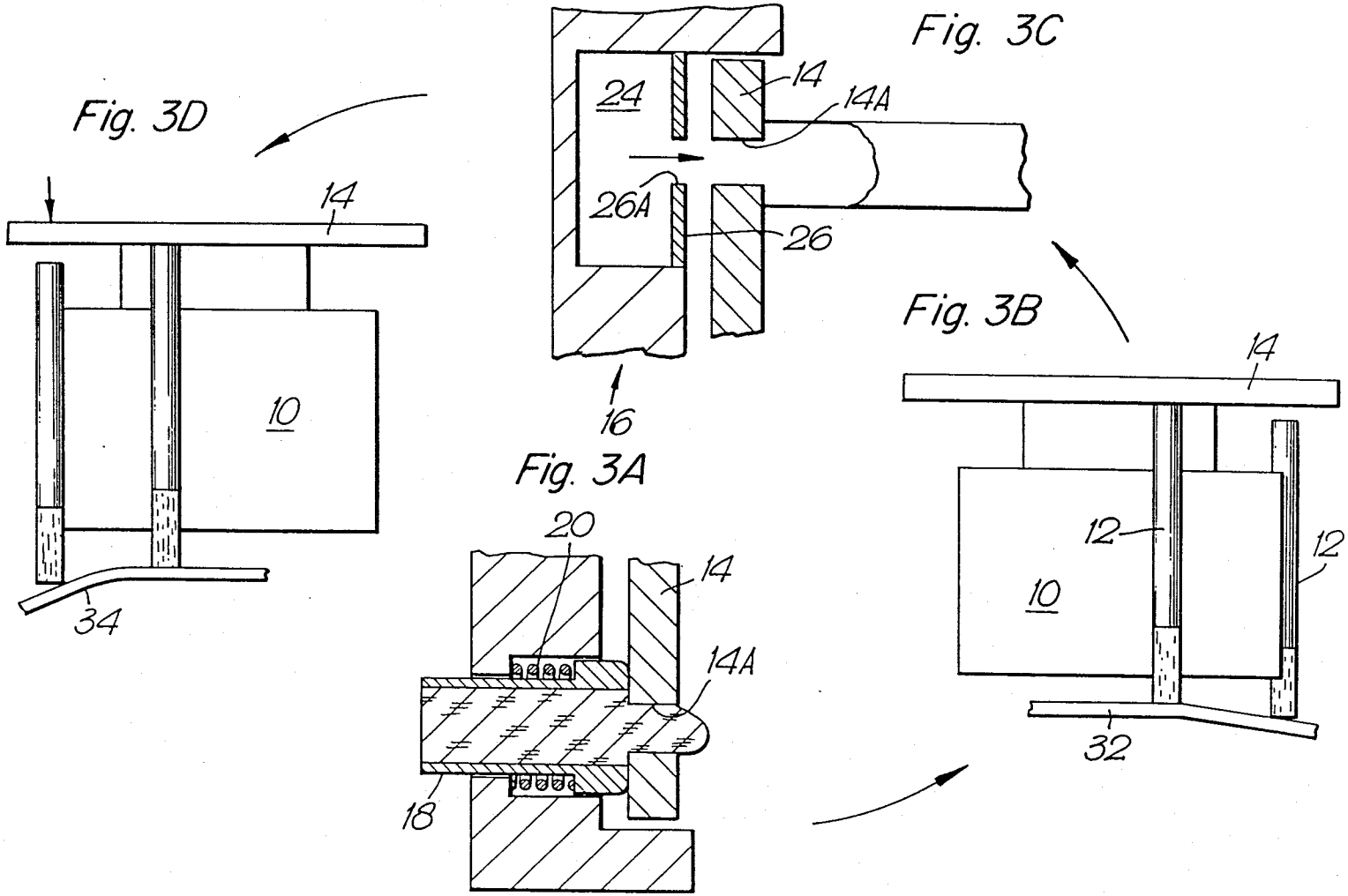
FIGS. 3A to 3D illustrate diagrammatically the application of foam in four stages of operation A–D.

Foam is delivered into the apertures in the disc via a spring-loaded nozzle 18 shown most clearly in FIG. 3A. As shown in FIG. 3A, the nozzle 18 is urged against the disc 14 by a spring 20. Foam may be delivered to the nozzle at a pressure such that a small quantity protrudes from the front (right-hand) face, as shown in FIG. 3A. The protruding excess may be wiped away by a resilient wiper (not shown) immediately downstream of the nozzle. Alternatively, the disc 14 may be thicker and the foam flow rate may be such that foam only partly fills each aperture, so that wiping is unnecessary.

Figure 2:
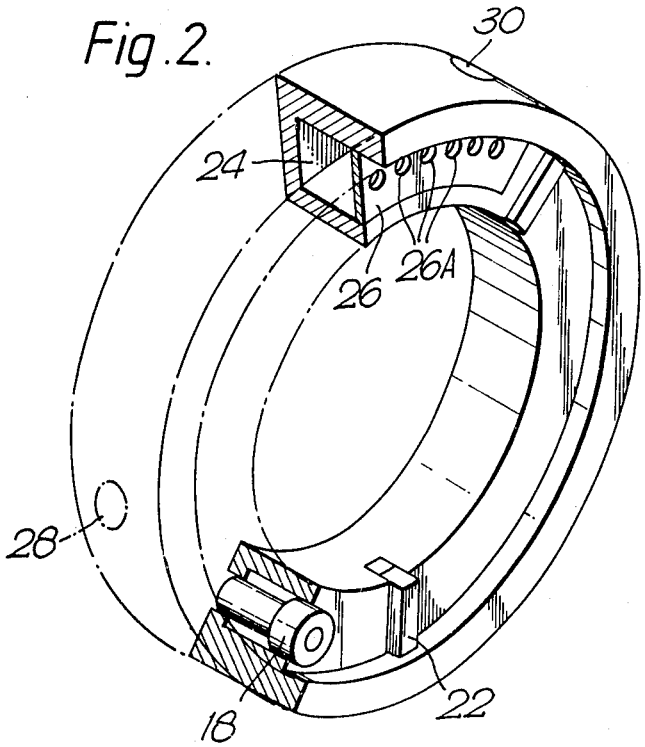
FIG. 2 is a perspective view, again partly broken away, of a manifold arrangement forming part of the apparatus.

Any foam remaining on the rear face of the disc downstream of the nozzle 18 is removed by a resilient wiper 22 shown in FIG. 2. There is preferably provision for drawing away excess foam removed by the wiper 22 and by the wiper on the other face of the disc 14, if any.

Air for tranferring the slugs of foam from the apertures 14A in the disc 14 is emitted from an arcuate manifold space 24 via apertures 26A in an arcuate plate 26 spaced from the disc 14, the apertures 26A being on the same pitch circle diameter as the apertures 14A in the plate 14. Air is supplied to the manifold space 24 from both ends thereof via inlets 28 and 30.

Thus, each slug of foam is progressively transferred onto the adjacent cigarette end, rather than being instantaneously blown onto the cigarette as described in our above-referenced U.S. application.

FIG. 3 shows the sequence of operations. At stage A, foam is delivered into the apertures in the disc 14 from the nozzle 18. Then at stage B each cigarette is pressed lightly against the disc 14, in this example by a guide rail 32. Low-velocity air jets from the apertures 26A in the plate 26, during stage C, transfer onto the cigarettes slugs of foam contained in the respective apertures 14A. Finally, at stage D, air flowing from the manifold 24 via the apertures 26A pushes the cigarettes away from the disc 14, movement of the cigarettes being restricted by a guide rail 34.

Figure 4:
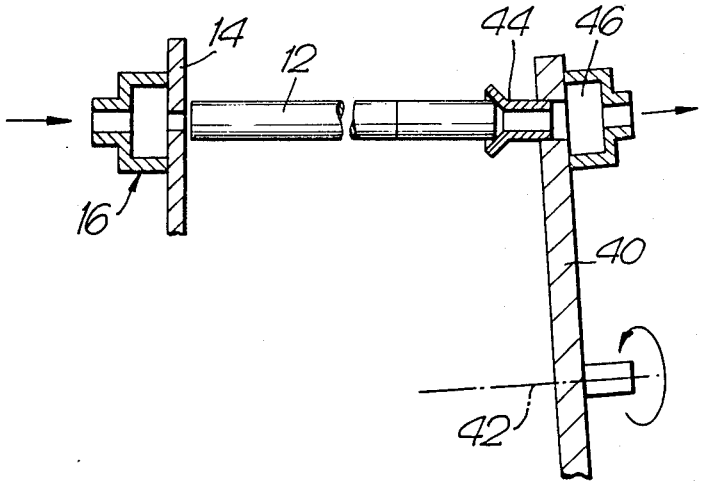
FIG. 4 is a diagrammatic illustration of a second example.

In place of the guide rail 32 for pushing the cigarettes towards and possibly into contact with the disc 14, a swashplate may be used as shown in FIG. 4. The swashplate consists of a disc 40 adjacent to one end of the drum (not shown) carrying the cigarettes, the disc 40 being arranged to rotate about an axis 42 inclined to the axis of the drum. Thus each of a number of flexible seals 44 is initially spaced from the corresponding cigarette 12 and, during rotation of the drum and disc 40, moves closer to the corresponding cigarette so as to engage and then axially displace the cigarette.

In the arrangement shown in FIG. 4 each member 44 serves as a seal and connects the corresponding filter end of the cigarette to a source of suction contained in a manifold 46. Suction applied thus to the filter end of each cigarette draws air through the cigarette and assists the entry of foam into the tobacco end adjacent to the disc 14. FIG. 4 shows the tobacco end slightly spaced from the disc 14, which is a possibility, but the tobacco end may alternatively be lightly pressed against the disc 14 by the flexible seal 44; in the latter case, tolerance of any slight variation in cigarette length is provided by the flexibility of the seal 44 which is axially compressible.

As an alternative, the transfer of foam into the cigarettes may be achieved purely by suction applied to the filter ends. This renders the apparatus readily tolerant to missing cigarettes on the drum 10. If air pressure is used to transfer or assist in transferring foam from the apertures in the disc 14, it is necessary to ensure that there are no missing digarettes on the drum, or that provision is made, for example, for removing slugs of foam corresponding to missing cigarettes, e.g. by sucking or blowing them out of the apertures before they reach the manifold 24.

Contact of the seals 44 with the cigarettes through a substantial arc of rotation (e.g. 30 to 60 degrees) may be achieved by allowing each seal to slide with respect to the swashplate disc 40 against the action of a spring and under the control of a cam having a "flat" in the relevant area.

The use of suction to transfer or assist in the transfer of foam into the cigarettes may involve the application of suction around the cigarette at the transfer station, as well as to the filter end, to increase the air flow into the tobacco end of the cigarette. For example, suction (e.g. of approximately 250 millibars or 2500 Pa) may be applied around each cigarette by means of a structure such as that described in our British Pat. No. 2,163,339; the suction chamber may extend so as to include any ventilation apertures in the filter wrapper.

In order to avoid excessive leakage of suction from the suction chamber of an arrangement such as that described in British Pat. No. 2,163,339, the end of the suction chamber adjacent to the ends of the cigarettes which receive the foam may be closed by a plate having circular apertures through which the cigarette ends are pushed by cam-operated pusher members at the other ends of the cigarettes (i.e. the filter ends in the case of filter cigarettes). For example for cigarettes of 8 mm diameter the circular apertures may be of 8.5 mm minimum diameter and may be flared or have associated conical mouth parts to guide in the cigarettes. The filter ends of the cigarettes may be within the suction chamber, the pusher members being arranged to pass through an adjacent end wall of the suction chamber. Following the application of foam, the cigarettes may be withdrawn from the circular apertures by the action of suction in the suction chamber.

Foam may be supplied to the disc 14 via a manifold formed in a disc-like pad mounted adjacent to and coaxial with the disc 14 and having a cylindrical flange surrounding the disc 14 with means for trapping the pad on the disc, for example by means of an inwardly extending ring secured to the flange. Thus the pad in effect floats on the disc 14, being held stationary while the disc rotates. Pressure air for ejecting slugs of foam from the apertures in the disc may be supplied through one or more additional manifolds formed in the pad. To prevent any escape of foam between the ring and the surrounding flange, the ring may be formed with a peripheral groove which is supplied with air at an appropriate above-atmospheric pressure; alternatively an equivalent internal groove in the flange may be provided for that purpose.

We claim:

1. Apparatus for applying measured quantities of foamed adhesive to the ends of cigarettes comprising a drum arranged to carry cigarettes sideways, a plate having apertures aligned with the respective cigarettes and arranged to receive and hold foam from a source adjacent to the plate, and means for pneumatically transferring foam progressively from each aperture to the end of the corresponding cigarette by pneumatically inducing air flows through said apertures.

2. Apparatus according to claim 1 in which the pneumatic means includes a source of suction applied to a number of cigarettes at the same time so as to induce a flow of air into the end of each of those cigarettes for progressively drawing or assisting in drawing the foam from each aperture towards and into the cigarette aligned therewith.

3. Apparatus according to claim 2 in which the source of suction communicates with one end of each cigarette (opposite to the end to receive the foam) and/or with a space around each cigarette.

4. Apparatus according to claim 3 including a suction manifold adjacent to a rotating disc having flexible seals arranged to engage the ends of corresponding cigarettes and through which suction is transmitted from the suction manifold.

5. Apparatus according to claim 4 in which the flexible seals are arranged to press the cigarettes lightly into contact with the plate with foam-carrying apertures.

6. Apparatus according to claim 1 in which the pneumatic means includes a manifold from which air at above-atmospheric pressure is arranged to flow towards a number of the foam-containing apertures at the same time so as to displace or assist in displacing each quantity of foam progressively from the corresponding aperture and towards the cigarette aligned therewith.

7. Apparatus according to claim 6 in which the manifold is formed with a number of outlets for directing jets of air towards the foam-carrying apertures in the plate, each quantity of foam being transferred from its aperture by the action of a succession of air jets from the manifold.

8. Apparatus according to claim 7 in which the outlets for air from the manifold comprise apertures in a plate forming one wall of the manifold, the apertures being at the same pitch circle as the foam-carrying apertures.

9. Apparatus according to claim 8 in which the apertured wall of the manifold is spaced from the plate with the foam-carrying apertures.

10. Apparatus according to claim 1 in which foam is supplied to the apertures in the plate via a nozzle which is spring-loaded into contact with the plate.

11. Apparatus according to claim 1 including means for wiping excess foam off one or both surfaces of the plate before cigarettes are brought into contact or proximity with the plate to receive foam from the apertures in the plate.

12. A method of applying measured quantities of foamed adhesive to the ends of cigarettes, comprising the steps of feeding measured quantities of foam into apertures in a plate aligned with the cigarettes, and then progressively transferring said measured quantities of foam from said apertures onto the corresponding cigarette ends by passing air flows which are additional to air contained in the foam through a plurality of the apertures at the same time.

13. A method according to claim 12 in which the air flows are produced or enhanced by suction pressure applied to the ends of the cigarettes opposite to those receiving the foam and/or by suction around the cigarettes.

14. A method according to claim 12 in which the air flows are produced or enhanced by pressure air passing from outlets in a manifold which outlets are aligned with the foam-carrying apertures of the plate.

* * * * *